US009708819B2

(12) United States Patent
Koenigsmark et al.

(10) Patent No.: US 9,708,819 B2
(45) Date of Patent: Jul. 18, 2017

(54) CROWN MOULDING SYSTEM

(71) Applicants: Gene Koenigsmark, Barnegat, NJ (US); David Black, Atlantic Highlands, NJ (US)

(72) Inventors: Gene Koenigsmark, Barnegat, NJ (US); David Black, Atlantic Highlands, NJ (US)

( * ) Notice: Subject to any disclaimer, the term of this patent is extended or adjusted under 35 U.S.C. 154(b) by 0 days.

(21) Appl. No.: 14/932,511

(22) Filed: Nov. 4, 2015

(65) Prior Publication Data

US 2017/0121984 A1 May 4, 2017

(51) Int. Cl.
*E04B 2/00* (2006.01)
*E04F 19/04* (2006.01)

(52) U.S. Cl.
CPC ..... *E04F 19/0436* (2013.01); *E04F 19/0486* (2013.01); *E04F 2019/044* (2013.01)

(58) Field of Classification Search
CPC ..... E04F 19/0436; E04F 19/0486; E04F 2019/044
USPC ..... 52/288.1
See application file for complete search history.

(56) References Cited

U.S. PATENT DOCUMENTS 1,825,010 A 9/1931 Murphy
5,001,877 A * 3/1991 Edwards ..... B44C 5/00 403/295
5,426,901 A 6/1995 Indracek
5,433,048 A 7/1995 Strasser
5,711,123 A * 1/1998 Lamont ..... E04F 19/02 40/650
5,836,113 A * 11/1998 Bachman ..... E04D 13/158 52/287.1
6,918,977 B1 * 7/2005 Maurer ..... E04F 19/0436 156/249
7,114,826 B1 * 10/2006 Lilly ..... F21V 21/02 362/146
D551,959 S 10/2007 Hargis
7,607,812 B2 * 10/2009 Kim ..... F21S 8/033 362/602
7,958,685 B2 6/2011 Rowohlt
8,534,016 B2 * 9/2013 DePaul ..... E04F 19/0436 52/288.1
8,779,290 B1 * 7/2014 DePaul ..... H02G 3/0431 174/68.3
2006/0059826 A1 * 3/2006 Leeman ..... E04F 13/10 52/506.01
2006/0070329 A1 * 4/2006 Schiltz ..... B44C 5/0461 52/506.01
2007/0258263 A1 * 11/2007 Kim ..... F21S 8/033 362/602
2010/0005741 A1 * 1/2010 Tripp ..... B23D 19/04 52/288.1

(Continued)

*Primary Examiner* — Joshua J Michener
*Assistant Examiner* — Keith Minter

(57) ABSTRACT

A crown molding system includes at least one first member that may be coupled to a horizontal support surface. At least one second member is provided. The at least one second member may be coupled to the vertical support surface. A panel is removably coupled between the at least one first member and the at least one second member. Thus, the at least one first member, the at least one second member and the panel may present the appearance of crown molding. At least one line is provided. The at least one line is positioned behind the panel such that the at least one line may be concealed.

9 Claims, 6 Drawing Sheets

(56) References Cited

U.S. PATENT DOCUMENTS

| | | | | |
|---|---|---|---|---|
| 2011/0108318 | A1* | 5/2011 | Pawlak | E04F 19/04<br>174/504 |
| 2014/0338276 | A1* | 11/2014 | Halischuk | E04F 19/0463<br>52/272 |
| 2015/0013256 | A1* | 1/2015 | Mea | E04F 13/0733<br>52/288.1 |

* cited by examiner

CROWN MOULDING SYSTEM

BACKGROUND OF THE DISCLOSURE

Field of the Disclosure

The disclosure relates to crown moulding devices and more particularly pertains to a new crown moulding device for concealing an electrical line or the like behind the crown moulding.

SUMMARY OF THE DISCLOSURE

An embodiment of the disclosure meets the needs presented above by generally comprising at least one first member that may be coupled to a horizontal support surface. At least one second member is provided. The at least one second member may be coupled to the vertical support surface. A panel is removably coupled between the at least one first member and the at least one second member. Thus, the at least one first member, the at least one second member and the panel may present the appearance of crown moulding. At least one line is provided. The at least one line is positioned behind the panel such that the at least one line may be concealed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
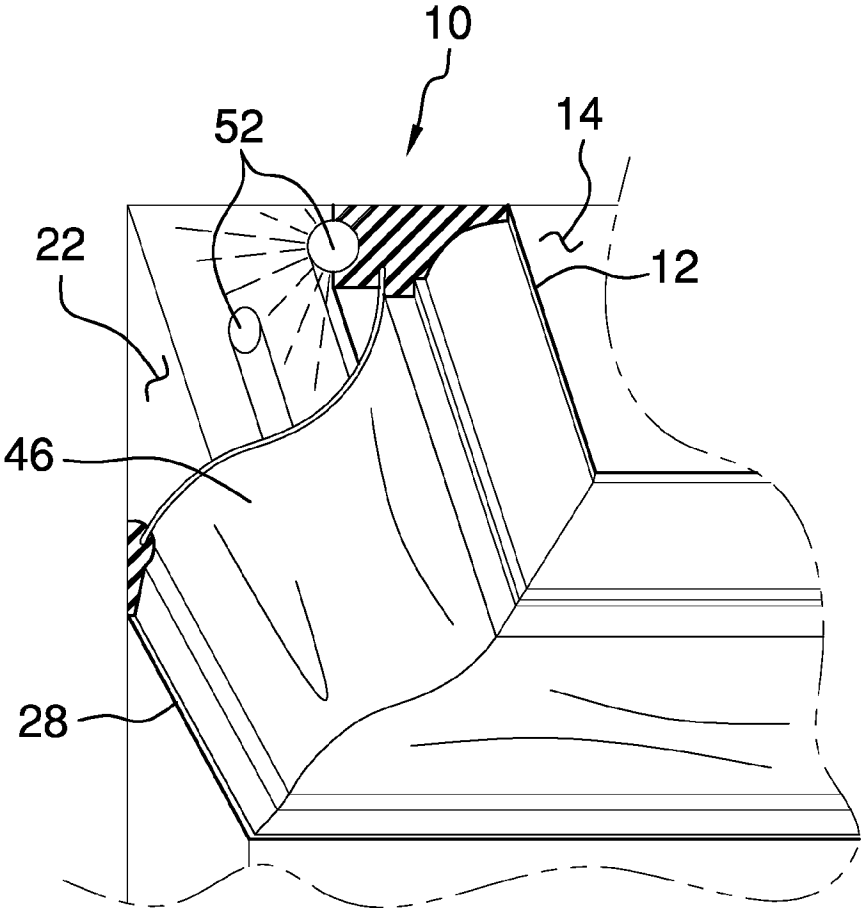
FIG. 1 is a perspective in-use view of a crown moulding system with an ogee curve according to an embodiment of the disclosure.
Figure 2:
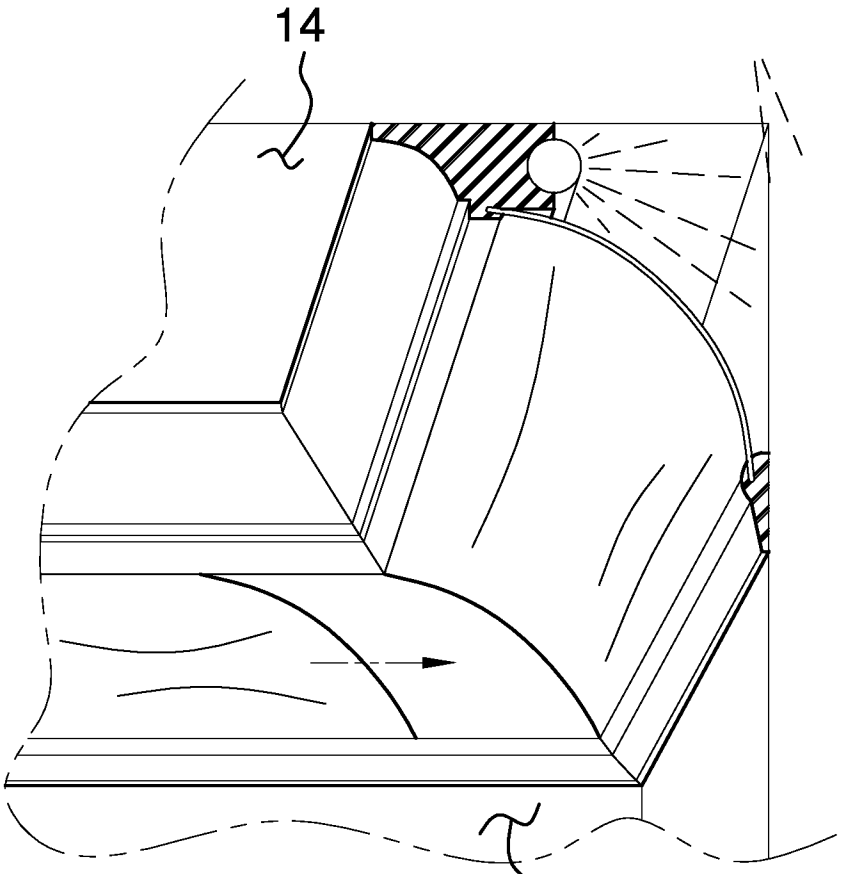
FIG. 2 is a perspective in-use view of an embodiment of the disclosure with a concave curve.
Figure 3:
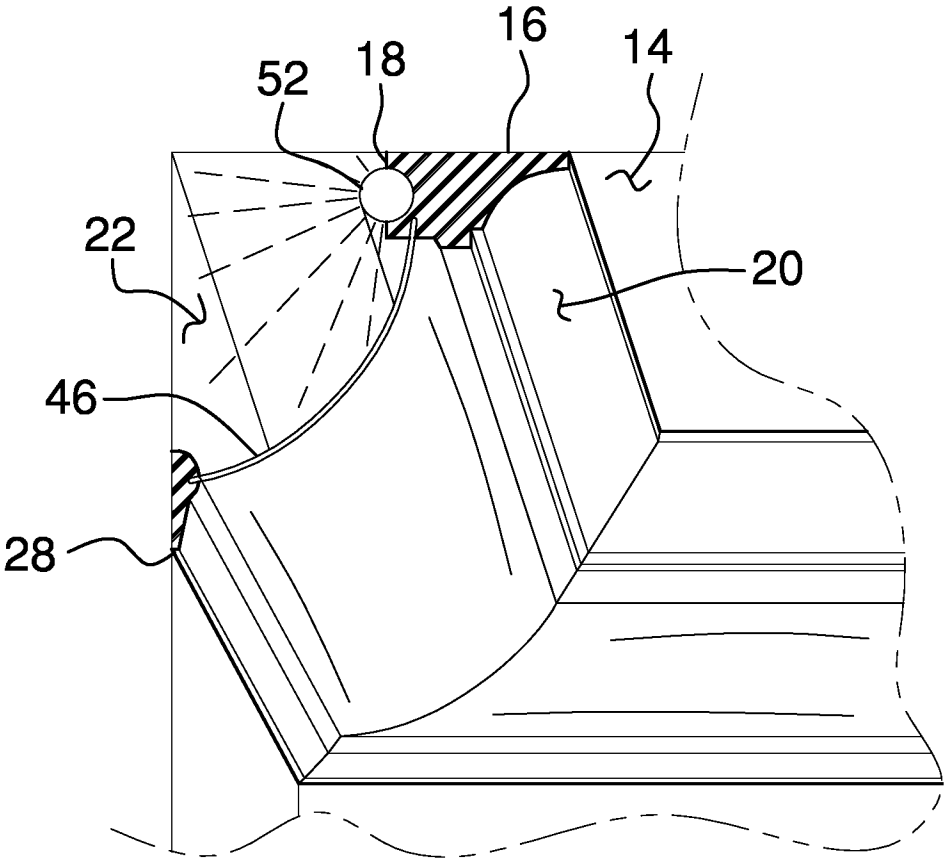
FIG. 3 is a perspective in-use view of an embodiment of the disclosure with a convex curve.
Figure 4:
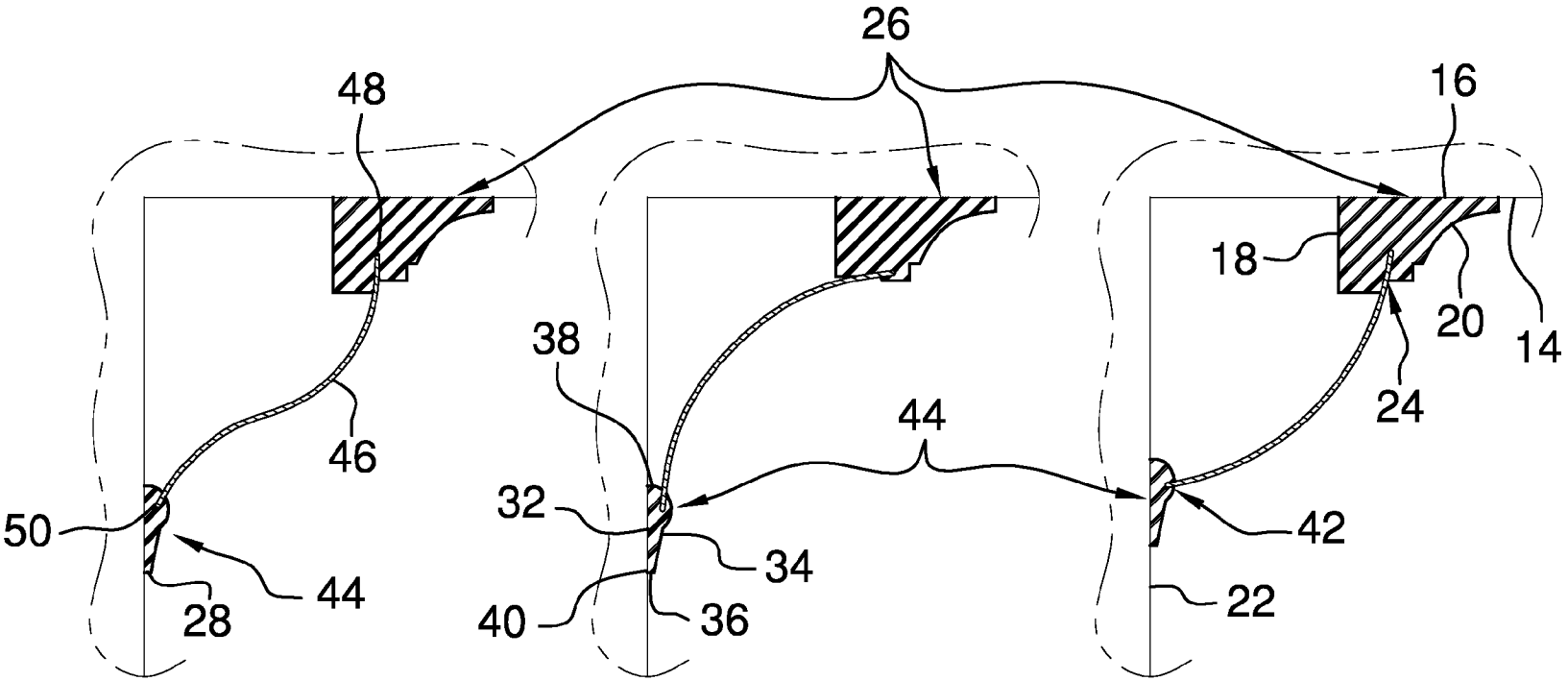
FIG. 4 is an end view of an embodiment of the disclosure.
Figure 5:
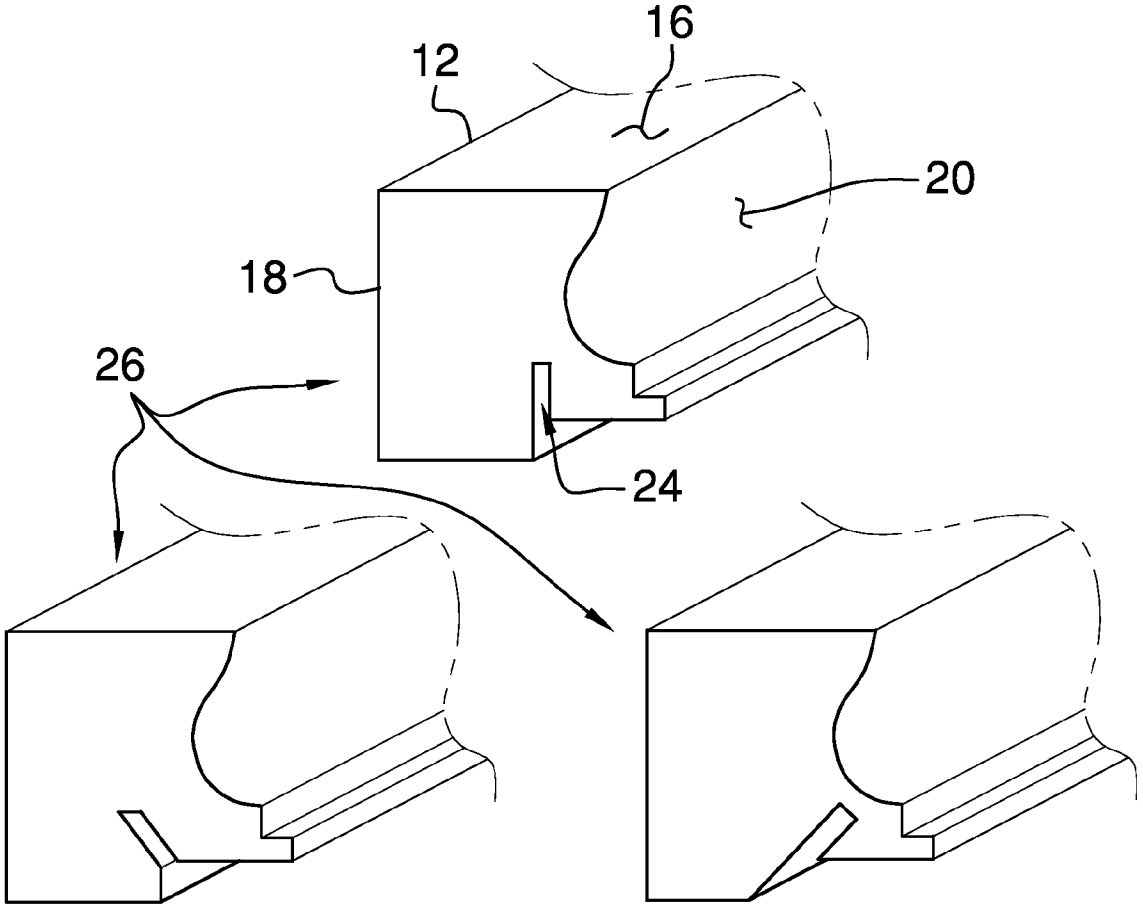
FIG. 5 is a perspective view of an embodiment of the disclosure.
Figure 6:
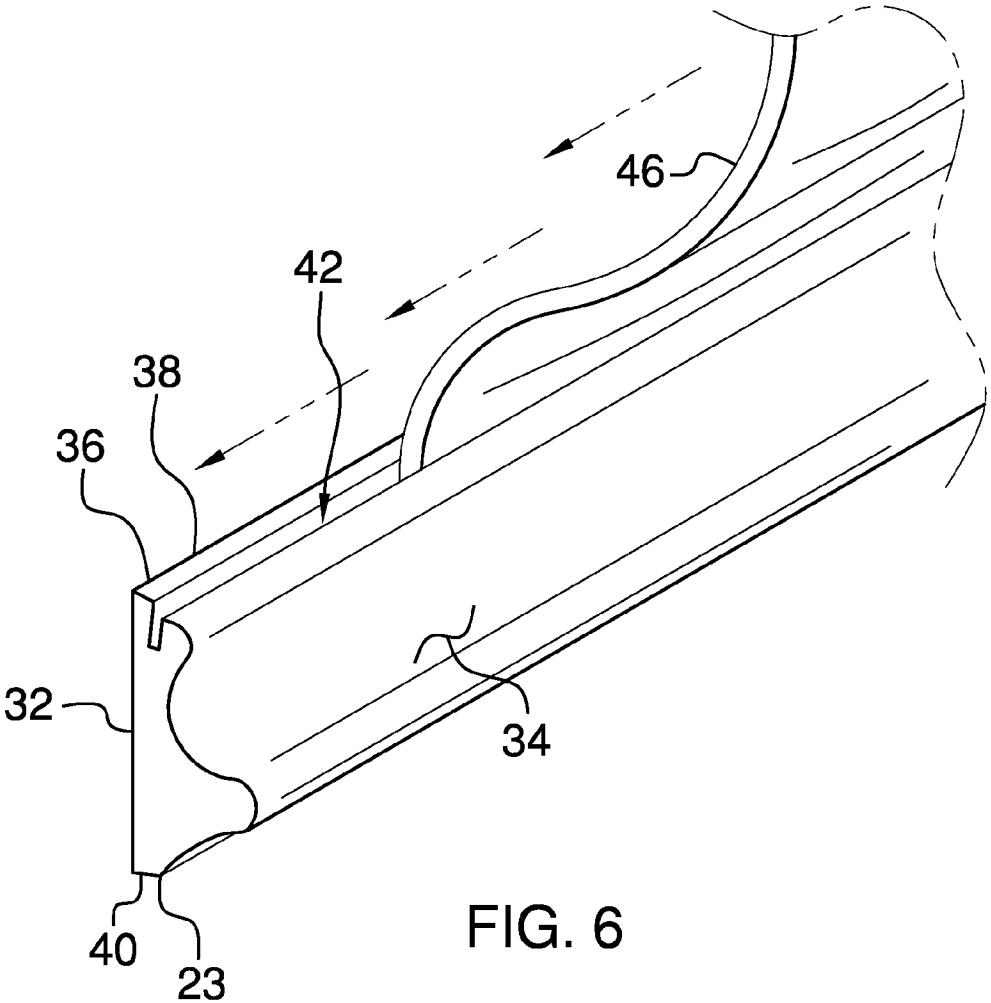
FIG. 6 is a front perspective view of an embodiment of the disclosure.

With reference now to the drawings, and in particular to FIGS. 1 through 6 thereof, a new crown moulding device embodying the principles and concepts of an embodiment of the disclosure and generally designated by the reference numeral 10 will be described.

As best illustrated in FIGS. 1 through 6, the crown moulding system 10 generally comprises at least one first member 12 that may be coupled to a horizontal support surface 14. The horizontal support 14 surface may comprise a ceiling or the like. The at least one first member 12 has a first surface 16, a second surface 18 and a third surface 20. The first surface 16 and the second surface 18 intersect at a right angle. The third surface 20 extends between the first surface 16 and the second surface 18 such that the third surface 20 substantially defines a hypotenuse of a triangle.

The third surface 20 undulates between the first surface 16 and the second surface 18. Additionally, the third surface 20 may comprise a plurality of angles and other geometric shapes that extend between the first surface 16 and the second surface 18. Thus, the third surface 20 defines an ornamental appearance of the at least one first member 12. The ornamental appearance of the at least one member 12 may be any ornamental appearance associated with crown moulding. The first surface 16 is coupled to the horizontal support surface 14. The at least one first member 12 is positioned such that the second surface 18 is coextensively spaced from an intersection of the horizontal support surface 14 and a vertical support surface 22.

The third surface 20 has a first slot 24 extending inwardly therein. The first slot 24 is positioned closer to the second surface 18 than the first surface 16. The first slot 24 is longitudinally coextensive with the at least one first member 12. The at least one first member 12 is one of a plurality of first members 26. The first slot 24 of each of the plurality of first members 26 is oriented at a plurality of angles with respect to the second surface 18 of an associated one of the first members 12.

At least one second member 28 is provided. The at least one second member 28 may be coupled to the vertical support surface 22. The vertical support surface 22 may comprise a wall or the like. The at least one second member 28 has a back surface 32, a front surface 34 and a peripheral edge 36 extending between the back surface 32 and the front surface 34.

The peripheral edge 36 has a top side 38 and a bottom side 40. The front surface 34 undulates between the top side 38 and the bottom side 40. Thus, the front surface 34 defines an ornamental appearance of the at least one second member 28. The ornamental appearance of the at least one second member 28 may be any ornamental appearance associated with crown moulding. The back surface 32 may be coupled to the vertical support surface 22. The at least one second member 28 is oriented such that the top side 38 is coextensively spaced from the intersection of the horizontal support surface 14 and the vertical support surface 22.

The front surface 34 has a second slot 42 extending inwardly therein. The second slot 42 is positioned closer to the top side 38 than the bottom side 40. The second slot 42 is longitudinally coextensive with the at least one second member 28. The at least one second member 28 is one of a plurality of second members 44. The second slot 42 of each of the second members 44 is oriented at a plurality of angles with respect to the back surface 32 of an associated one of the second members 44.

A panel 46 is removably coupled between the at least one first member 12 and the at least one second member 28. Thus, the at least one first member 12, the at least one second member 28 and the panel 46 may present the appearance of crown moulding. The panel 46 has a first edge 48 and a second edge 50. The first edge 48 is inserted into the first slot 24 and the second edge 50 is inserted into the second slot 42. The panel 46 is comprised of a deformable material. Thus, the panel 46 is selectively forms a concave arc, a convex arc and an ogee between the at least one first member 12 and the at least one second member 28.

At least one line 52 is provided. The at least one line 52 is positioned behind the panel 46 such that the at least one line 52 may be concealed. The at least one line 52 may comprise an electrical wire, a plumbing pipe or other line associated with building construction. Additionally, the at least one line 52 may comprise tubular security lighting or the like.

In use, a selected one of the plurality of first members 26 is coupled to the horizontal support surface 14. The selected first member 26 is oriented to be coextensive with and spaced from the intersection of the horizontal support surface 14 and the vertical support surface 22. A selected one of the plurality of second members 44 is coupled to the vertical support surface 22. The selected second member 44 is oriented to be coextensive with and spaced from the intersection of the vertical support surface 22 and the horizontal support surface 14. The panel 46 is positioned to extend between the selected first member 26 and the selected second member 44. The at least one line 52 is inserted between the panel 46 and the intersection of the horizontal support surface 14 and the vertical support surface 22. Thus, the at least one line 52 is concealed.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A crown moulding system comprising:

at least one first member being configured to be coupled to a horizontal support surface;

at least one second member being configured to be coupled to a vertical support surface;

a panel being removably coupled between said at least one first member and said at least one second member wherein said at least one first member, said at least one second member and said panel are configured to present the appearance of crown moulding;

at least one line, said at least one line being positioned behind said panel wherein said at least one line is configured to be concealed; and wherein said at least one first member having a first surface, a second surface and a third surface, said first surface and said second surface intersecting at a right angle, said third surface extending between said first surface and said second surface such that said third surface substantially defines a hypotenuse of a triangle, said third surface undulating between said first surface and said second surface wherein said third surface is configured to define an ornamental appearance of said at least one first member.

2. The system according to claim 1, wherein said first surface is configured to be coupled to the horizontal support surface thereby facilitating said second surface to be coextensively spaced from an intersection of the horizontal support surface and a vertical support surface.

3. The system according to claim 2, wherein said third surface has a first slot extending inwardly therein, said first slot being positioned closer to said second surface than said first surface, said first slot being longitudinally coextensive with said at least one first member.

4. The system according to claim 1, wherein:

said at least one member has a first slot;

said at least one second member has a second slot; and said panel having a first edge and a second edge, said first edge being inserted into said first slot, said second edge being inserted into said second slot.

5. The system according to claim 4, wherein said panel is comprised of a deformable material such that said panel selectively forms a concave arc, a convex arc and an ogee between said first member and said second member.

6. A crown moulding system comprising:

at least one first member being configured to be coupled to a horizontal support surface;

at least one second member being configured to be coupled to a vertical support surface;

a panel being removably coupled between said at least one first member and said at least one second member wherein said at least one first member, said at least one second member and said panel are configured to present the appearance of crown moulding;

at least one line, said at least one line being positioned behind said panel wherein said at least one line is configured to be concealed; and wherein said at least one second member has a back surface, a front surface and a peripheral edge extending between said back surface and said front surface, said peripheral edge having a top side and a bottom side, said front surface undulating between said top side and said bottom side wherein said front surface is configured to define an ornamental appearance of said at least one second member.

7. The system according to claim 6, wherein said back surface is configured to be coupled to the vertical support surface thereby facilitating said top side to be coextensively spaced from the intersection of the horizontal support surface and the vertical support surface.

8. The system according to claim 7, wherein said front surface has a second slot extending inwardly therein, said second slot being positioned closer to said top side than said bottom side, said second slot being longitudinally coextensive with said at least one second member.

9. A crown moulding system comprising:

at least one first member being configured to be coupled to a horizontal support surface, said at least one first member having a first surface, a second surface and a third surface, said first surface and said second surface intersecting at a right angle, said third surface extending between said first surface and said second surface such that said third surface substantially defines a hypotenuse of a triangle, said third surface undulating between said first surface and said second surface wherein said third surface is configured to define an ornamental appearance of said at least one first member, said first surface being configured to be coupled to the horizontal support surface thereby facilitating said second surface to be coextensively spaced from an intersection of the horizontal support surface and a vertical support surface, said third surface having a first slot extending inwardly therein, said first slot being positioned closer to said second surface than said first surface, said first slot being longitudinally coextensive with said at least one first member;

at least one second member being configured to be coupled to the vertical support surface, said at least one second member having a back surface, a front surface and a peripheral edge extending between said back surface and said front surface, said peripheral edge having a top side and a bottom side, said front surface undulating between said top side and said bottom side wherein said front surface is configured to define an ornamental appearance of said at least one second member, said back surface being configured to be coupled to the vertical support surface thereby facilitating said top side to be coextensively spaced from the intersection of the horizontal support surface and the vertical support surface, said front surface having a second slot extending inwardly therein, said second slot being positioned closer to said top side than said bottom side, said second slot being longitudinally coextensive with said at least one second member;

a panel being removably coupled between said at least one first member and said at least one second member wherein said at least one first member, said at least one second member and said panel are configured to present the appearance of crown moulding, said panel having a first edge and a second edge, said first edge being inserted into said first slot, said second edge being inserted into said second slot, said panel being comprised of a deformable material such that said panel selectively forms a concave arc, a convex arc and an ogee between said at least one first member and said at least one second member; and at least one line, said at least one line being positioned behind said panel wherein said at least one line is configured to be concealed.

* * * * *